US006702453B2

(12) United States Patent
Weedon

(10) Patent No.: US 6,702,453 B2
(45) Date of Patent: Mar. 9, 2004

(54) FLEXIBLE LIGHT FIXTURE

(75) Inventor: Darrin Weedon, Santa Ana, CA (US)

(73) Assignee: Birchwood Lighting, Inc., Santa Ana, CA (US)

( * ) Notice: Subject to any disclaimer, the term of this patent is extended or adjusted under 35 U.S.C. 154(b) by 14 days.

(21) Appl. No.: 10/066,196

(22) Filed: Oct. 26, 2001

(65) Prior Publication Data

US 2003/0081413 A1 May 1, 2003

(51) Int. Cl.[7] ..... F21S 4/00

(52) U.S. Cl. ..... 362/219; 362/224; 362/225; 362/220; 362/269; 362/287; 362/227; 362/238

(58) Field of Search ..... 362/219, 217, 362/224, 225, 227, 220, 269, 287, 371, 238, 250; 174/61–64

(56) References Cited

U.S. PATENT DOCUMENTS

| | | | |
|---|---|---|---|
| 2,298,824 | A | 10/1942 | Darley |
| 2,535,372 | A | 12/1950 | Schaeffer et al. |
| 2,555,000 | A | 5/1951 | Nitardy |
| 3,064,121 | A | 11/1962 | Greene |
| 3,117,728 | A | 1/1964 | Waldbauer |
| 3,154,281 | A | 10/1964 | Frank |
| 3,404,268 | A | 10/1968 | Fowler |
| 3,602,759 | A | 8/1971 | Evans et al. |
| 3,753,036 | A | 8/1973 | Roche |
| 3,798,481 | A | 3/1974 | Poliara |
| 3,913,849 | A | 10/1975 | Atanasoff et al. |
| 3,946,203 | A | 3/1976 | Hecht et al. |
| 4,056,724 | A | 11/1977 | Harte |
| 4,070,498 | A | 1/1978 | Nishizawa et al. |
| 4,080,067 | A | 3/1978 | Massengeil |
| 4,105,910 | A | 8/1978 | Evans |
| 4,109,303 | A | 8/1978 | Hetherington |
| 4,123,862 | A | 11/1978 | Dyer et al. |
| 4,130,429 | A | 12/1978 | Van Doorselaer |
| 4,144,452 | A | 3/1979 | Harte |
| 4,156,270 | A | 5/1979 | Beatty |
| 4,156,893 | A | 5/1979 | Baake |
| 4,163,502 | A | 8/1979 | Korte |
| 4,180,164 | A | 12/1979 | Durden et al. |
| 4,204,273 | A | 5/1980 | Goldberg |
| 4,222,880 | A | 9/1980 | Baur et al. |
| 4,234,817 | A | 11/1980 | Teshima et al. |
| 4,240,130 | A | 12/1980 | Stilling |
| 4,260,219 | A | 4/1981 | Greubel et al. |
| 4,264,124 | A | 4/1981 | Greubel et al. |

(List continued on next page.)

FOREIGN PATENT DOCUMENTS

| | | | | |
|---|---|---|---|---|
| GB | 21441 | | of 1898 | |
| GB | 2240389 A | * | 7/1991 | ..... B60Q/1/06 |
| JP | 3-22301 A | | 1/1991 | ..... F21S/5/00 |

OTHER PUBLICATIONS

Sentinel Lighting, 32100X0 Compact Fluorescent with Overlapping Lamps, Jul. 6, 2001.

Sentinel Lighting, 32100X0 Compact Fluorescent with Overlapping Lamps, Jul. 6, 2001.

Celestial Lighting—Specifier Guide, UBL 5000 BX–X, Flexible Biax Fluorescent Channelite, Drawing No. 403 copyright 2000.

(List continued on next page.)

*Primary Examiner*—Stephen Husar
*Assistant Examiner*—Sharon Payne
(74) *Attorney, Agent, or Firm*—McDermott Will & Emery

(57) ABSTRACT

Adjacent housings of a light fixture each mount a lamp. A rigid, hollow fitting extends between adjacent housings. The fitting's outside diameter is small enough relative to openings in the housings that receive the connector that adjacent housings can pivot, rotate and move longitudinally and pivot on the connectors. Electric wiring passes through the connectors between the housings.

24 Claims, 2 Drawing Sheets

U.S. PATENT DOCUMENTS

| | | | | | |
|---|---|---|---|---|---|
| 4,287,555 | A | | 9/1981 | Stilling | |
| 4,306,758 | A | | 12/1981 | Johnson et al. | |
| 4,318,163 | A | | 3/1982 | Bryan | |
| 4,432,043 | A | | 2/1984 | Yuen | |
| 4,439,818 | A | | 3/1984 | Scheib | |
| 4,449,169 | A | | 5/1984 | Warshawsky | |
| 4,454,569 | A | * | 6/1984 | Maguire | 362/127 |
| 4,475,236 | A | | 10/1984 | Hoffman | |
| 4,545,302 | A | | 10/1985 | DeLorenzo | |
| 4,572,989 | A | | 2/1986 | Zuchtriegel | |
| 4,574,336 | A | | 3/1986 | Mikalonis | |
| 4,607,317 | A | | 8/1986 | Lin | |
| 4,621,309 | A | | 11/1986 | Grawe et al. | |
| 4,658,289 | A | | 4/1987 | Nagano et al. | |
| 4,680,275 | A | | 7/1987 | Wagner et al. | |
| 4,745,285 | A | | 5/1988 | Recktenwald et al. | |
| 4,749,061 | A | | 6/1988 | Orndorff et al. | |
| 4,753,704 | A | | 6/1988 | Stewart | |
| 4,804,845 | A | | 2/1989 | Takeuchi | |
| 4,837,162 | A | | 6/1989 | Rothman et al. | |
| 4,929,561 | A | | 5/1990 | Hirschfeld | |
| 4,930,008 | A | | 5/1990 | Suzuki et al. | |
| 4,954,891 | A | | 9/1990 | Burk et al. | |
| 4,989,215 | A | | 1/1991 | Winik | |
| 5,037,615 | A | | 8/1991 | Kane | |
| 5,037,763 | A | | 8/1991 | Petisce | |
| 5,060,125 | A | | 10/1991 | Cowie et al. | |
| 5,072,535 | A | | 12/1991 | Jenkins | |
| 5,097,135 | A | | 3/1992 | Makino et al. | |
| 5,130,548 | A | | 7/1992 | Sano et al. | |
| 5,138,223 | A | | 8/1992 | Osada et al. | |
| 5,170,100 | A | | 12/1992 | Shichao et al. | |
| 5,173,637 | A | | 12/1992 | Sica | |
| 5,174,647 | A | | 12/1992 | Kelly | |
| 5,182,660 | A | | 1/1993 | Tanaka | |
| 5,189,339 | A | | 2/1993 | Peshak | |
| 5,201,576 | A | | 4/1993 | Squyres | |
| 5,221,139 | A | * | 6/1993 | Belfer | 362/225 |
| 5,235,497 | A | | 8/1993 | Costa | |
| 5,355,290 | A | | 10/1994 | Tickner | |
| 5,377,086 | A | | 12/1994 | Tickner | |
| 5,386,353 | A | | 1/1995 | Battaglia | |
| 5,436,816 | A | * | 7/1995 | Nagano | 362/219 |
| 5,448,460 | A | * | 9/1995 | Belfer et al. | 362/225 |
| 5,452,187 | A | | 9/1995 | Belfer et al. | |
| 5,555,162 | A | | 9/1996 | Shemitz | |
| 5,727,871 | A | | 3/1998 | Kotloff | |
| 6,059,424 | A | | 5/2000 | Kotloff | |
| 6,198,292 | B1 | | 3/2001 | Kirk et al. | |
| RE37,310 | E | | 8/2001 | Shemitz | |

OTHER PUBLICATIONS

H E. Williams, Inc. 1989, Series 74, surface or pendant mounted staggered one or two–lamp strip, 2 pages.

Acme Lighting and Manufacturing Co., 1974, p. 1–14, 1650 Series, single lamp strip.

STG Series, 1970.

Norbert Belfer Lighting catalog, copyright 1990, 40 pages.

Birchwood Lighting, Inc., The Linear Lighting Specialists, The WP System, Sydney Field Curvable, 4 pages copyright 2000.

Litelab Corp. Submittal Fluorescent Light Strips, Dated May 9, 1991, Revised Oct. 28, 1991 F40BX Biaxial Lamp.

Belfer Lighting for Architecture, Tools for the Lighting Professional, copyright 2001 Belfer, 16 pages.

Belfer Lighting for Architecture, Compact Fluorescent Lighting, Tools for the Lighting Professional, copyright 2000 48 pages.

Norbert Belfer Lighting, Cat. No. 2715, Low Voltage Lighting Specialists since 1968. FLEXX–LITE, 6 pages, 1991.

Summons & Complaint for Patent Infringement and Request for Trial by Jury Ezra Sutton, Filed Oct. 30, 2001.

Answer, Mark Wine, Dated Jun. 20, 2001.

Plaintiff's Lighting World's Memorandum of Law in Support of Motion for Summary Judgment of Infringement of U.S. Pat. 5,448,460, Eztra Sutton, Sep. 24, 2002.

Plaintiff's Motion for Summary Judgment of Infringement of U.S. Pat. 5,221,139 Ezra Sutton, Sep. 24, 2002.

Birchwood's Opposition to Plaintiff's Motion for Summary Judgment of Infringement of U.S. Pat. Nos. 5,448,460, Mark P. Wine Oct. 6, 2002.

Order Denying Plaintiff's Motion for Summary Judgment of Infringement of U.S. Pat. No. 5,221,139, U.S. District Court Judge, Percy Anderson, Dec. 2, 2002.

Order: (1) Denying Defendant's Motion for Summary Judgement of Invalidity of U.S. Pat. No. 5,448,460; and (2) Denying Plaintiff's Motion for Summary Judgment of Infringement of U.S. Pat. No. 5,448,460, U.S. District Court Judge, Percey Anderson, Dec. 2, 2002.

Modification of Court's Order Denying Plaintiff's Motion for Summary Judgment of Infringement if U.S. Pat. No. 5,221, 139, U.S. District Court Judge, Percy Anderson, Jan. 28, 2003.

Judgment, U.S. District Court Judge, Percy Anderson, Jun. 9, 2003.

Plaintiff's Notice of Appeal, Ezra Sutton, Jul. 9, 2003.

Belfer Lighting for Architecture catalog. Your Hidden Advantage for High–Profile Lighting, In Step With the Best Belfer Step Lighting, 6 pages, 1997.

Belfer Lighting for Architecture catalog, 1999 Specifier's Guide. Tools for the Lighting Professional, 244 pages.

Tivoli Product Guide, Cove Lighting, Copyright 2002, Targetti North America 2.01, 8 pages.

* cited by examiner

FLEXIBLE LIGHT FIXTURE

BACKGROUND OF THE INVENTION

1. Field of the Invention

The present invention is a light fixture of the type that conforms to is mounting location.

2. General Background and State of the Art

Fluorescent lamps of present fixtures are arranged linearly. Thus, the lamps are side-by-side or end-to-end. Some fixtures use curved lamps, but the lamps are designed to allow a single lamp to extend along the sides of a fixture and have the sides interconnected.

Belfer, U.S. Pat. No. 5,221,139 (1993), is an example of a light fixture in which the lamps mount end-to-end. Belfer mounts each u-shaped lamp on a ramp or at an angle so that part of one lamp is above the socket of the adjacent lamp. This arrangement is said to decrease or eliminate shadows above the sockets. Therefore, the light is said to be more even. The lamps in Belfer are aligned in a straight line. Applicant has discovered that allowing the lamps to be other than aligned may be desirable.

Flexible light fixtures with flexible parts do exist. The flexible parts are usually resilient and often resist staying in an angled orientation. Examples include Belfer, U.S. Pat. No. 5,448,460 (1995), which teaches a lighting fixture with several support sections. Each carries a fluorescent lamp. Adjacent edges of adjacent support sections attach together through a flexible connection. Nagano, U.S. Pat. No. 5,436,816 (1995) teaches a fixture having multiple housings. Short sections of flexible electrical conduit fixed to adjacent housings attach adjacent housings together. The flexible conduit permits bending of adjacent housing. These partially flexible fixtures normally do not permit extensive lateral changes of the position of the lamps. The teachings of the prior art discussed above are incorporated by reference.

INVENTION SUMMARY

One object of the present invention is to provide a lighting fixture in which the user can position the lamps closer and farther apart so that the lamps can be spaced evenly along a given length. For example, assume that one wants illumination to emanate from five lamps behind a six foot wide panel or sconce. Unless the fixture providing the illumination were six feet long with evenly-spaced lamps, the lighting would not be even. Any shorter fixture mounted in the center of the panel would leave darker regions at the ends, and larger fixtures would not fit.

The previous example assumed that the lamps would be in a straight line. Many architectural features are curved, angled to the horizontal or vertical. Mounting straight fixtures in such settings also leaves uneven lighting in places. Therefore, another object of the present invention is to allow the lamps to be mounted at angles to each other so that they can conform more closely with the shape of their panel or wall. Moreover, a related object is to have the ability to adjust the angles quickly and have the lamps remain in the set position after they are adjusted.

Another object of the present invention is to allow the lamps to be mounted at different attitudes and to be adjusted to those angles quickly. The lamps of prior art fixtures all direct light in the same direction, e.g., upward or horizontally. For some uses, one may want one lamp to project most of its light upward while an adjacent lamp projects most of its light horizontally or at an angle.

DETAILED DESCRIPTION OF THE PREFERRED EMBODIMENTS

Figure 1:
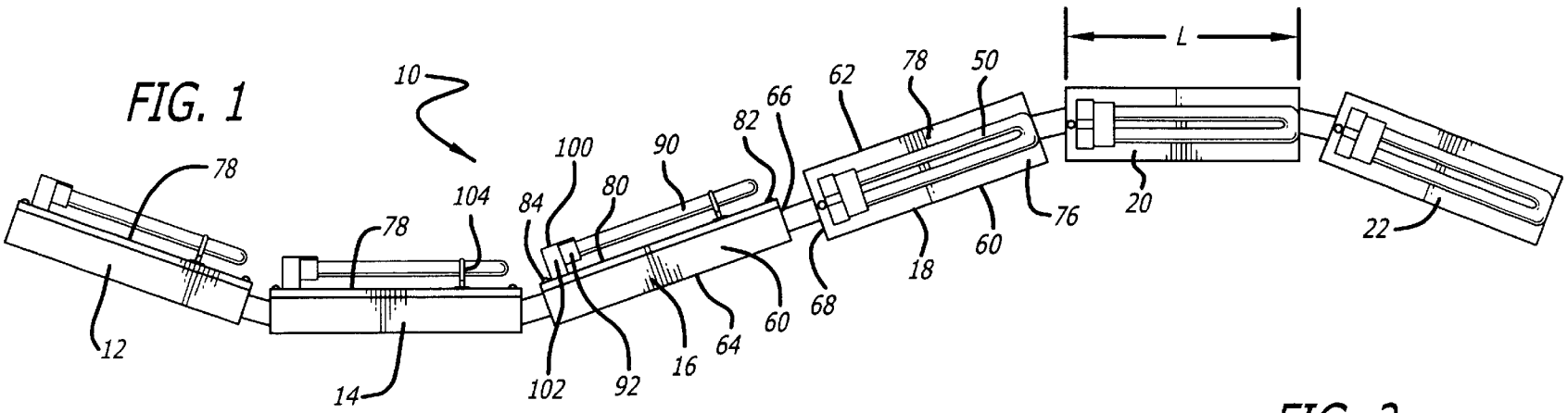
FIG. 1 is a front view of one embodiment of the present invention.

The exemplary embodiments 10, 30 (FIGS. 1 and 2) of the fixture of the present invention includes at least two housings. Each exemplary embodiment has six housings. Fixture 10 has housings 12, 14, 16, 18, 20 and 22, and fixture 30 has housings 32, 34, 36, 38, 40 and 42. Each fixture is elongated in the "L" dimension (FIG. 1) (The $L_1$ dimension in FIG. 2). The total fixture length varies depending on the number of housings, the spacing and angles between them and their length L or $L_1$. In the exemplary embodiment, length L is 11 in (28 cm), and length $L_1$ is 8 in (20 cm) (metric measurements are approximate and rounded). The length is a matter of choice and relates to the lengths of lamps such as lamp 50.

Figure 3:
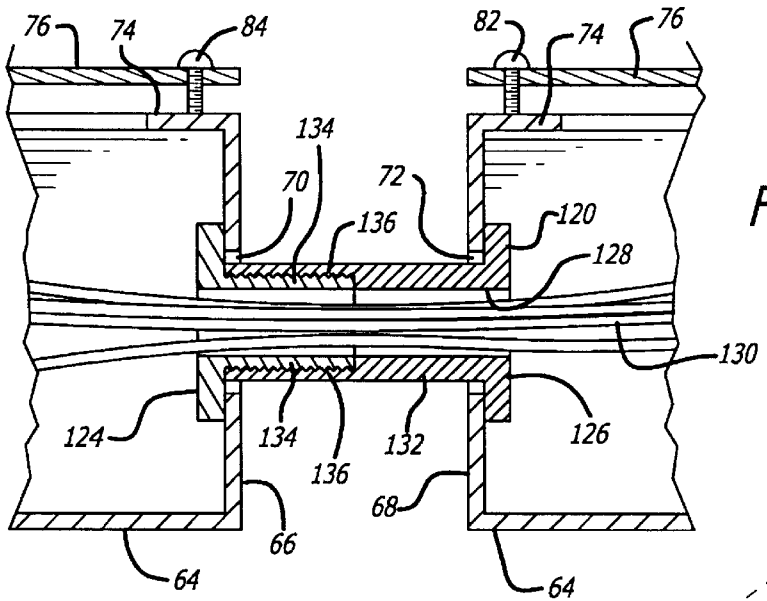
FIG. 3 is a sectional view of parts of an exemplary embodiment of two adjacent housings of the present invention with a connector attaching them together.

Referring to housings 16 and 18 by way of their being representative of other housings, the housings are hollow (see FIG. 3) and rectangular. Formed of sheet steel, the housing could be aluminum or plastic, metal is preferred to act as electrical ground. The metal is bent to form a rectangular box. The housings have side walls 60 and 62 and a base 64. End walls 66 and 68 are bent upward from the base to form the ends. Small amounts of material may be removed where the bending will occur. The end walls are bent inward to form small platforms 74 (FIG. 3). The side walls and base may have a small hole or holes to receive fasteners for attaching the housing to walls, panels or other building parts.

Each end wall has an opening 70 and 72 (FIG. 3), which may be closed by a knockout or breakaway cap (not shown). As is well known, a blow to the breakaway cap pushes it into the housing where it is removed. The knockout openings in the exemplary embodiment are ⅞ in (17 mm) in diameter, which is standard.

The bent metal that forms the base, side walls, end walls and platforms does not form the top wall of the housing in the exemplary embodiment. Instead, an elongated cap 76 forms the top of the housing in the exemplary embodiment. Cap 76 has a top surface 78 and two bent walls 80 (the drawings show only one). The side walls 60 and 62 fit within the bent walls 80 of the cap so that the cap closes the top of the housing.

The top cap also is removable from the rest of the housing to allow access into the housing. In the exemplary embodiment, sheet metal screws 82 and 84 (FIGS. 1–3) extend through the top surface 78 and into the platforms. The screws secure the top cap to the rest of the housing. Removing the screws allows one to remove the top cap. The cap could be partially removable or have a door to permit access into the housing. Likewise, access to the housing can be through another wall.

Each housing has a lamp fitting to which one can mount a lamp. The exemplary embodiment uses U-shaped fluorescent lamps 50. Sylvania DULUX® L compact fluorescent lamps are acceptable. The wattage varies for each application. Though the exemplary embodiment uses fluorescent tubes, other types of lamps are acceptable.

A lamp fitting mounts on the top of the end cap. The exemplary fitting 100 (FIG. 1) is compatible with the chosen lamp. It has a plastic female member 102 and female conductors that receive the conductors and the plastic end cap 92 of lamp 50. The female member 102 in FIG. 1 has flanges (not shown). Rivets or other fasteners through the flanges secure the fitting to the top surface 78 of top cap 76. A flexible, plastic lamp support 104 attaches at the end of the top cap 76 away from the lamp fitting. In the exemplary embodiment, the lamp support has an upward-facing U-shaped grip. The sides of the grip are spaced apart slightly less than the width of lamp 50. The top of each grip is spaced slightly less than the bottom of the grip. Pushing the lamp into the grip spreads the flexible sides of the grip slightly. The lamp rests at the bottom of the grip, and the top sides of the grip come toward each other to secure the lamp in the grip. The previously mentioned Nagano patent discloses a similar lamp support. The lamp support has an extension below the grip that is press fit through an opening in the top cap. Other fasteners or even adhesive could secure the lamp support 104 to the housing.

Figure 2:
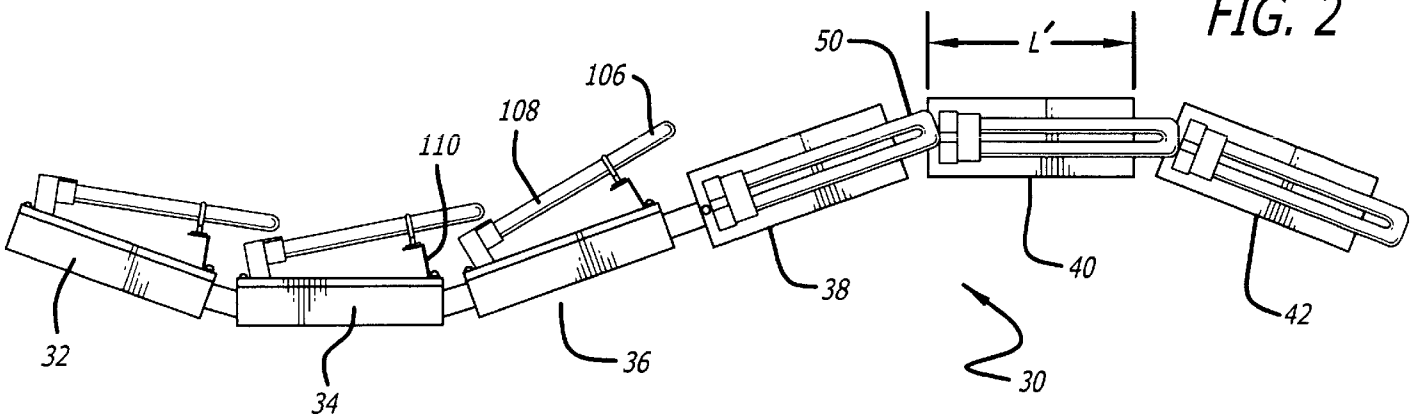
FIG. 2 is a front view of another embodiment of the present invention.

As FIG. 1 shows, lamps 50 are parallel to the top surface of the end cap. In FIG. 2, however, the lamps 50 are at an angle to the end cap, i.e., end 106 of lamp 50 is spaced farther from and end 108 is spaced closer to the top surface 78 of the housing. That allows the lamps to overlap. See the lamps on housings 32 and 34 (FIG. 2).

A bent metal plate 110 attaches to the female member and to the top surface 78 of top cap 76 (FIG. 2). In the exemplary embodiment, rivets (not shown) secure the plate 110 to the top cap. Screws secure the female member to the plate. The same lamp support 104 that the embodiment in FIG. 1 uses attaches to the top of the bent metal plate 110. An opening in the top of the bent metal plate receives a downward-facing extension to secure lamp support 104 to the plate.

The housings attach together as follows. As discussed above, each housing has an opening 70 and 72 in one or both end walls 66 and 68. The breakaway caps in the left end wall of housings 12 and 32 and the right end wall of housings 22 and 42 would not be removed. Consequently, those housings would have only one opening.

Figure 4:
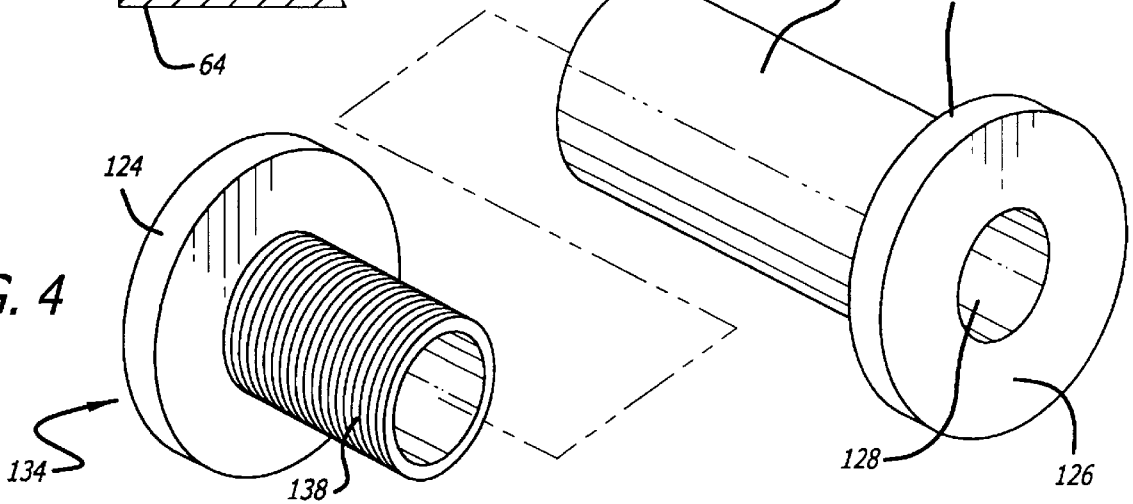
FIG. 4 is an exploded view of the connection of an exemplary embodiment of the present invention.

An elongated connector extends through the openings on adjacent housings. The connector 120 of the exemplary embodiment has a central, cylindrical section 122 (FIGS. 3 and 4) and a pair of end flanges 124 and 126. The connector is hollow with a central bore 128 extending through the connector. Electrical conductors 130 pass through the bore between the housings.

The connector has two parts, sleeve 132 and bolt 134. The inside of the sleeve has internal threads 136 that engage the external threads 138 of the bolt. The outside diameter of the sleeve is ¾ in (19 mm). That leaves enough of a space between the outside of the sleeve and the inside of the ⅞ in inside diameter openings 70 and 72 that the housings can move longitudinally, rotate and pivot with respect to the connector. The thin walls of the housing offer little interference with connector-to-bolt pivoting. In fact, the space between the outside of the connector and the inside of the opening allows the housings to be angled enough such that the edges of adjacent housings contact each other. The contact limits the angle. This degree of pivoting is referred to as "substantial." If the connector is approximately the same diameter as the opening such that pivoting is not expected, some pivoting still takes place. That is not substantial pivoting.

The flanges 124 and 126 have 1¼ in (32 mm) diameters in the exemplary embodiment. Therefore, they cannot fit through openings 70 and 72.

The housings are generally rigid. In the exemplary embodiment, the connectors are metal of thick enough walls to be rigid. Some resiliency may be acceptable. If the connector is plastic, for example, one may be able to deform the sleeve somewhat, but the sleeve will return to its original shape. Similarly, one may be able to deform the flanges somewhat. The parts are not purposely flexible, and the sleeve and bolt are not designed to bend to change the angle of adjacent housings.

Returning to FIGS. 1 and 2, the mounting of the connectors in the opening allows the housings to move longitudinally, rotate and pivot with respect to each other. Accordingly, housings 18 and 20, which face upward (from the page) are at an angle to each other on the plane of the drawing. Housing 16 is rotated 90° relative to housing 18. Top faces 78 of housings 12 and 14 also are angled to each other on the plane of the drawing. One can change the angles of the housings and the amount of rotation of adjacent housings simultaneously to obtain a desired fixture and lamp positioning.

Housing spacing also is variable. The length of the connector is 1½ in (38 mm) and about 1¼ in (32 mm) between the inside of the flanges 124 and 126. Therefore, the housings can be spaced between 1½ in apart or if the housings are aligned, the housings can be in contact. Maximum and minimum distances change if the housings are angled. Thus, FIG. 2 shows that housings 36 and 38 are spaced farther apart than housings 34 and 36.

Changing the angle and spacing may also affect whether the ends 106 of lamps 50 are over the fittings 100. Compare the lamps on housings 32 and 34 with those on housings 40 and 42. Of course, the lamps on housings 36 and 38 have no overlap because the housings are rotated relative to each other.

By changing the angles, the housings and illumination from the lamps on the housings can approximate the shape of the panel or wall on or behind which the fixture mounts. Similarly, by rotating the housings relative to each other, light from the lamps can project upward, sideways and at angles to each other. Changing the spacing of the housing can space the lamps evenly along a given length.

To assemble the fixtures, top surfaces 76 are removed from adjacent housings (assuming the top surfaces are already attached). The breakaway caps are removed to form openings 70 and 72. Sleeve 132 is inserted through opening 72, and nut 134 is inserted at or through opening 70. The sleeve and nut then are screwed together. Hand tightening normally is sufficient. The remaining fixtures are attached together in the same way. Then, the fixture is wired, and the top surfaces are returned to the housing and fastened in place by screws 82 and 84.

While the specification describes particular embodiments of the present invention, those of ordinary skill can devise variations of the present invention without departing from the inventive concept.

We claim:

1. A light fixture comprising:

a) at least two housings;

b) a lamp fitting on each housing, the lamp fitting being adapted to mount a lamp to the fitting;

c) each housing having an opening;

d) a generally rigid, elongated connector extending through the openings on adjacent housings, the connectors being of a size relative to the openings to permit the housings to rotate, move longitudinally and pivot substantially on the connectors; and e) each connector having an end member larger than the openings to prevent removal of the connector from the openings.

2. The light fixture of claim 1 wherein each connector is formed of at least two parts that attach to each other.

3. The light fixture of claim 2 wherein each connector is hollow to allow electrical conductors to pass through each connector between adjacent housings.

4. The light fixture of claim 1 wherein the housing has at least a first wall, the first wall being at least partially removable from the housing for access into the housing.

5. The light fixture of claim 4 wherein the lamp fitting mounts on the first wall.

6. The light fixture of claim 5 wherein the lamp fitting is positioned to mount a lamp having a distal and a proximate end such that the distal end of the lamp is farther from the first wall than the proximal end is to the first wall.

7. The light fixture of claim 1 wherein the lamp fitting is positioned to mount a lamp having a distal and a proximate end such that the distal end of the lamp is farther from the housing than the proximal end is to the housing.

8. A light fixture comprising:

a) at least two hollow housings formed by elongated walls having two ends, and end walls at the ends of the elongated walls, at least one end wall of each housing having an opening;

b) a lamp fitting on at least one elongated wall of each housing adapted to receive a lamp;

c) an elongated connector having ends, each end extending into the opening of two adjacent housings, the connector being of a size relative to the openings to permit the housings to rotate, move longitudinally and pivot on the connectors; and e) an end member on the ends of the connector, each end member being larger than the opening in the housing to prevent removal of the connector from the opening.

9. The light fixture of claim 8 wherein each connector is formed of at least two parts that attach to each other.

10. The light fixture of claim 9 wherein each connector is hollow to allow electrical conductors to pass through each connector between adjacent housings.

11. The light fixture of claim 8 wherein the housing has at least a first wall, the first wall being at least partially removable from the housing for access into the housing.

12. The light fixture of claim 11 wherein the lamp fitting mounts on the first wall.

13. The light fixture of claim 12 wherein the lamp fitting is positioned to mount a lamp having a distal and a proximate end such that the distal end of the lamp is farther from the first wall than the proximal end is to the first wall.

14. The light fixture of claim 8 wherein the lamp fitting is positioned to mount a lamp having a distal and a proximate end such that the distal end of the lamp is farther from the housing than the proximal end is to the housing.

15. The light fixture of claim 8 wherein each connector is rigid.

16. The light fixture of claim 8 wherein each end member on the ends of the connector is a flange.

17. A light fixture comprising:

a) an elongated housing having elongated walls and a pair of end walls at the end of the elongated walls;

b) an opening through at least one end wall of the housing;

c) a connector having a longitudinal length, means for mounting the connector within the opening such that the connector can pivot substantially, move longitudinally and rotate within the opening, the connector being hollow to allow electrical conductors to pass through each connector between adjacent housings.

18. The light fixture of claim 17 wherein each connector is formed of at least two parts that attach to each other.

19. A method for positioning lamps on a light fixture comprising:

a) positioning a fitting for receiving a lamp on each of at least two housings, each housing having a part that is at least partially removable to allow access into the housing, each housing having an opening;

b) positioning one part of an elongated, two-part connector through the opening in one housing, and positioning the other part of the two-part connector at the opening of another housing;

c) attaching the parts of the two-part connector together;

d) the portion of the connector within the openings being of a size relative to the openings to permit the housings to rotate, move longitudinally and pivot substantially on the connectors.

20. The method of claim 19 further comprising blocking an end of each part of the connector to prevent the connector from being removed from the opening after the parts of the connector are attached together.

21. The method of claim 19 further comprising pivoting one housing relative to the other housing.

22. The method of claim 19 further comprising moving one housing relative to the other housing along the connector.

23. The method of claim 19 further comprising rotating one housing relative to the other housing.

24. A light fixture comprising:

a) at least two housings;

b) a lamp fitting on each housing, the lamp fitting being adapted to mount a lamp to the fitting;

c) each housing having an opening;

d) a rigid, elongated connector extending through the openings on adjacent housings to permit the housings to rotate, move longitudinally and pivot substantially on the connectors; and e) each connector having an end member larger than the openings to prevent removal of the connector from the openings.

* * * * *